United States Patent [19]

Fitzgerald

[11] Patent Number: 4,846,437

[45] Date of Patent: Jul. 11, 1989

[54] BRACKET FOR SUPPORTING CONCRETE FORMWORK

[76] Inventor: Leonard R. Fitzgerald, 2659 Pacific Highway, Eight Mile Plains, Q. 4123, Australia

[21] Appl. No.: 87,160

[22] Filed: Aug. 19, 1987

[30] Foreign Application Priority Data

Feb. 12, 1987 [AU] Australia ..... 68742/87

[51] Int. Cl.[4] ..... E01C 19/50; E04G 17/04

[52] U.S. Cl. ..... 249/3; 249/4; 249/6; 249/14; 249/47; 249/192; 249/208; 249/219.1

[58] Field of Search ..... 249/2–9, 249/13, 14, 18, 47, 134, 135, 163, 167, 188, 192, 208, 210, 219 R; 52/426, 563, 586; 29/467, 468

[56] References Cited

U.S. PATENT DOCUMENTS

| | | | |
|---|---|---|---|
| 1,035,206 | 8/1912 | Lewen | 52/426 |
| 1,637,998 | 8/1927 | Heltzel | 249/8 |
| 1,644,587 | 10/1927 | Heltzel | 249/5 |
| 1,672,760 | 6/1928 | Heltzel | 249/6 |
| 2,611,169 | 9/1952 | Torrelli | 249/9 |
| 2,991,532 | 7/1961 | Stiles | 249/188 |
| 4,340,200 | 7/1982 | Stegmeier | 249/6 |

FOREIGN PATENT DOCUMENTS

| | | | |
|---|---|---|---|
| 1299616 | 6/1962 | France | 52/426 |
| 629049 | 12/1961 | Italy | 249/219 R |

*Primary Examiner*—Jay H. Woo
*Assistant Examiner*—James C. Housel
*Attorney, Agent, or Firm*—Poms, Smith, Lande & Rose

[57] ABSTRACT

Mold fabrication apparatus for forming molds is disclosed. The mold fabrication apparatus includes edge members (10) with lipped flanges (12) which extend rearwardly from the mold face (11), and brackets (14) which are notched to engage with the lipped flanges (12) at any desired positions along each edge member (10). The brackets (14) are flanged to enable them to be secured to a surface to locate the edge members (10).

7 Claims, 11 Drawing Sheets

BRACKET FOR SUPPORTING CONCRETE FORMWORK

This invention relates to mould fabrication apparatus.

This invention has particular but not exclusive application to the construction of moulds for concrete slabs and the like, and for illustrative purposes reference will be made to such application. However, it is to be understood that this invention could be used in other applications, such as the erection of barriers and fences.

While there have been many advances in aspects of building construction techniques over the past thirty years, a great deal of concrete construction work is still carried out using formwork constructed from timber especially for each pour. This process is labour intensive, requires skilled labour and is wasteful of materials, since the timber is frequently damaged during stripping after the concrete has set.

The use of formed material sections as formwork overcomes some of the problems associated with timber formwork, but the joining and fixing of formed material sections, particularly steel sections, has hitherto been inconvenient, requiring fabrication of special supporting brackets and often the onsite use of welding equipment.

The present invention aims to alleviate the above disadvantages and to provide mould fabrication apparatus which will be reliable and efficient in use. Other objects and advantages of this invention will hereinafter become apparent.

With the foregoing and other objects in view, this invention in one aspect resides broadly in mould forming apparatus for retaining fluid concrete on a surface, including:

an elongate edge member having a moulding face at one side thereof against which fluid concrete may be cast and connection means remote from said moulding face and spaced along said edge member;

a plurality of supporting brackets releasably connectible to said connection means for supporting said edge member on said surface, and retaining means for retaining said supporting brackets on said surface.

Preferably, said elongate mould edge member has a flange extending therealong rearwardly from said mould face and which constitutes said connection means and whereby said supporting brackets may be retained in any selected spaced positions along said flange. Preferably, said flange is a lipped flange which may constitute one of a pair of opposed lipped flanges whereby said supporting brackets may engage both said lipped flanges to hold the mould face in a selected orientation.

Each said supporting bracket may have a body portion provided with notches engageable with the lips of said lipped flanges, and said notches may be located in said bracket whereby said supporting brackets may be pivoted relative to said edge member to engage or disengage said notches with or from said lips.

A plurality of notches may be provided in a bracket whereby the bracket may be engaged with the lips of the lipped flanges in a plurality of relative orientations, such that mould surfaces may be formed at a plurality of selected orientations to the surface to which the bracket is retained.

Preferably, said edge member is a lipped channel metal section.

The supporting brackets may be formed with complementary surfaces engageable with other supporting brackets whereby engagement of said complementary surfaces may form bracket assemblies engageable with a plurality of said edge members. Supporting bracket may be formed each having a body portion provided with an intermediate notch whereby said intermediate notch may be releasably engageable with adjoining flanges or lips of adjacent edge members and said notches may engage with the outermost lips of adjacent edge members.

Joining brackets may be provided having pairs of notched members in spaced relationship whereby the ends of adjacent sections of edge members may be aligned. The joining brackets may include locating pins which may be engaged with the edge members whereby the ends of adjacent sections of edge members may be held in juxtaposition.

While the mould face of an edge member may be flat, other shapes may be formed in the mould face, such that chamfered edges or shear key profiles may be moulded on the concrete in contact with the mould face.

Free-stripping edge members may be formed with rearwardlyconverging flanges, whereby an edge member may be removed from a mould face by rotation about the intersection of a mould face and a flange without interference between adjoining flanges of adjacent edge members. To facilitate the formation of mould faces through which reinforcing rods project, edge members may be formed having slotted apertures provided in a flange and in the mould face adjacent to the flange, whereby reinforcing rods may be passed through the slotted apertures.

Edge members may be formed from flexible plastics material, and handles may be provided connecting the lipped flanges at spaced intervals therealong whereby stripping of the edge members from concrete may be facilitated by pulling on the handles to distort the edge members.

In another aspect, this invention resides in ligature brackets having notches engageable with the lips of a spaced pair of lipped channels whereby the lipped channels may form the side walls of a cast concrete slab and the ligature brackets may form transverse reinforcement for said concrete slab.

In a further aspect, this invention resides in a method of retaining liquid concrete poured on a surface including:

(a) providing a lipped channel member for use as an edge member;

(b) arranging the lipped flanges of said lipped channel member remote from the mould cavity whereby the lipped channel web constitutes said mould face;

(c) providing supporting brackets engageable with the lips of said lipped channel at spaced locations along said lipped channel;

(d) connecting said supporting brackets to said lipped channel member at selected locations therealong, and (e) retaining said supporting brackets relative to said surface so as to position said lipped channel member at a selected position on said surface.

In order that this invention may be more easily understood and put into practical effect, reference will now be made to the accompanying drawings which illustrate a preferred embodiment of the invention, wherein.

Figure 1:
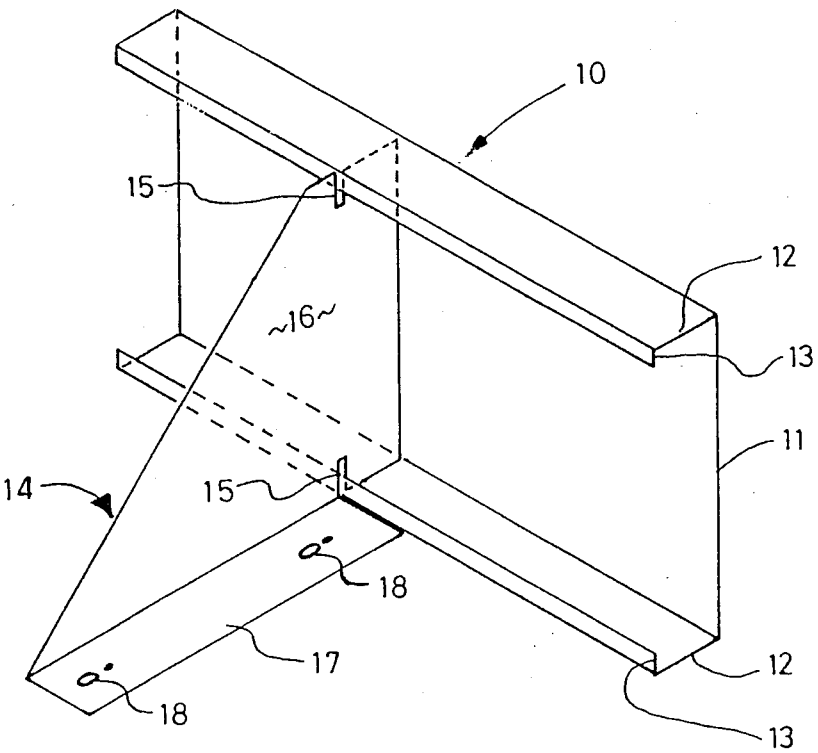
FIG. 1 is a pictorial view of an edge member engaged with a basic bracket.

As shown in FIG. 1, an edge member 10 is formed with a flat moulding surface 11 and projecting flanges 12 which terminate in formed lips 13. Basic bracket 14 has notches 15 cut in its web 16, these notches engaging with the lips 13 when the bracket 14 is inserted between the flanges 12 and rotated about an axis normal to the moulding surface 11. The bracket 14 has a flange 17 along its lower edge with a series of holes 18 formed in the flange 17 whereby the bracket 14 may be secured to a fixed location using bolts, nails or pegs.

To set up formwork for a concrete slab of thickness equal to the width of an edge member 10, a perimeter frame of edge members 10 is laid out on a flat surface, and brackets 14 are engaged with the lips 13 of the edge members 10 at desired intervals by inserting the brackets 14 between the flanges 12 and twisting the brackets 14 to engage the notches 15 with the lips 13. The brackets 14 may then be secured to the flat surface by means of bolts, nails or pegs passing through the holes 18 in the flanges 17 of the brackets 14 to form a rigid perimeter frame. The reverse of this procedure may be employed to remove the formwork.

Figure 2:
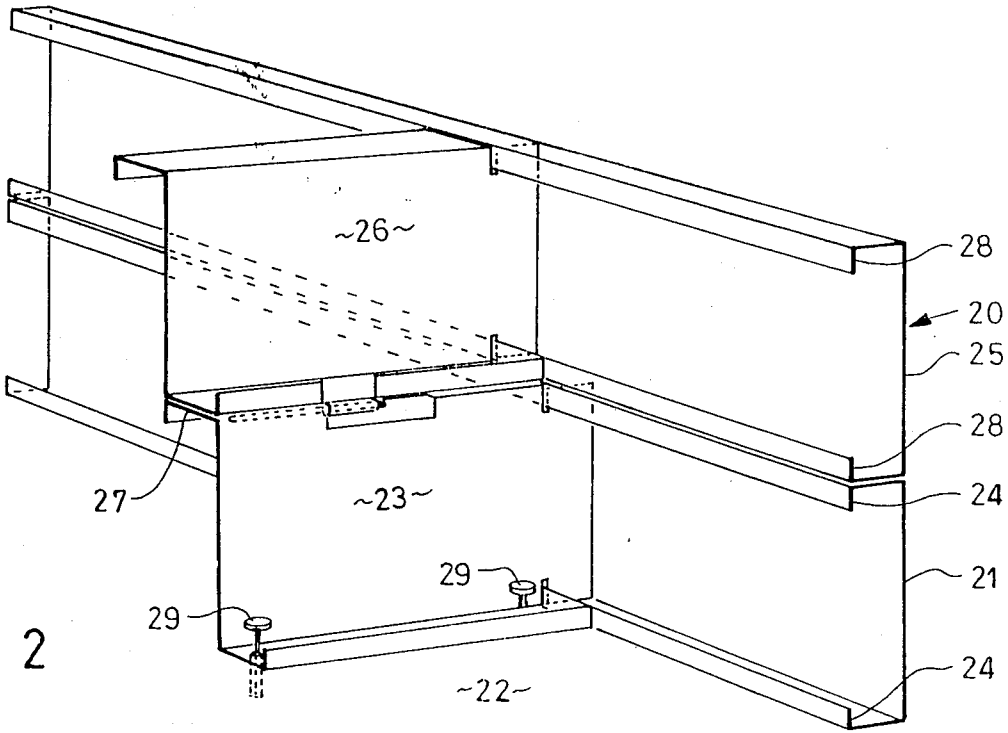
FIG. 2 is a pictorial view of a double-height mould formed from edge members and single-height brackets.

The double-height mould 20 shown in FIG. 2 is formed by placing a lower edge member 21 on a moulding surface 22 and engaging single-height bracket 23 with the lipped flanges 24 of the lower edge member 21, then placing the single-height bracket 23 on the moulding surface 22. An upper edge member 25 is then placed above the lower edge member 21 and a single height bracket 26 is engaged simultaneously with the upper flanges 27 of the single-height bracket 23 and the lipped flanges 28 of the upper edge member 25 The bracket 23 is then clamped to the moulding surface 22 with pegs 29.

Figure 3:
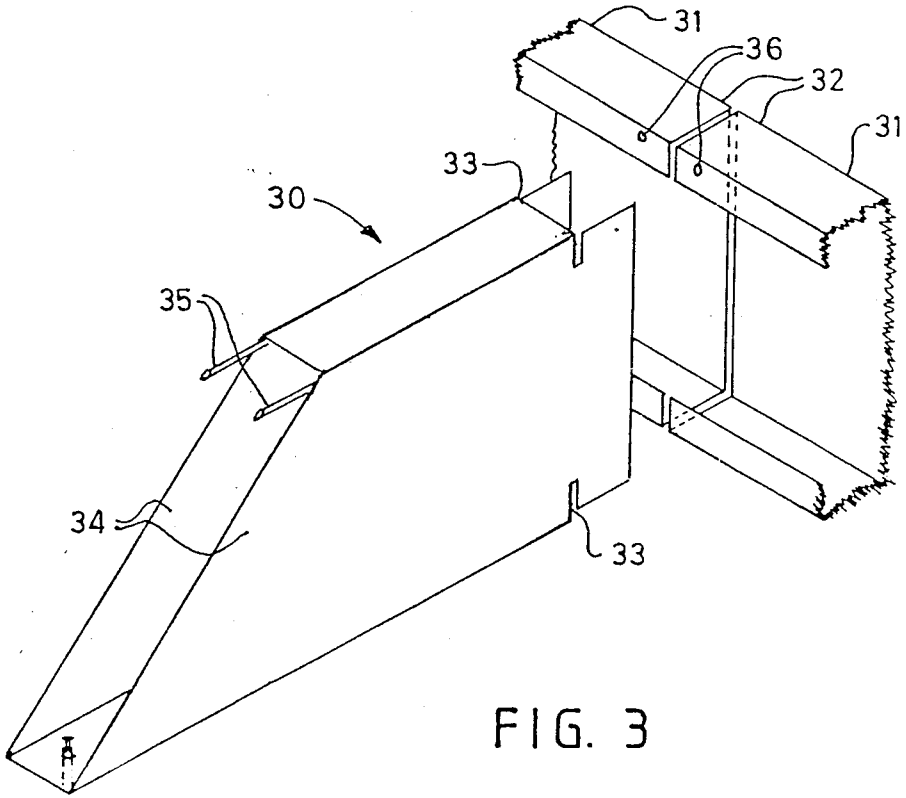
FIG. 3 is a pictorial view of two edge members joined end-to-end with a joining bracket.

As shown in FIG. 3, a joining bracket 30 may be used to join two edge members 31 end-to-end by sliding the ends 32 of the edge members 31 into the cutouts 33 in the side plates 34 of the joining bracket 30 and sliding the bolts 35 into holes 36 in the edge members 31.

Figure 4:
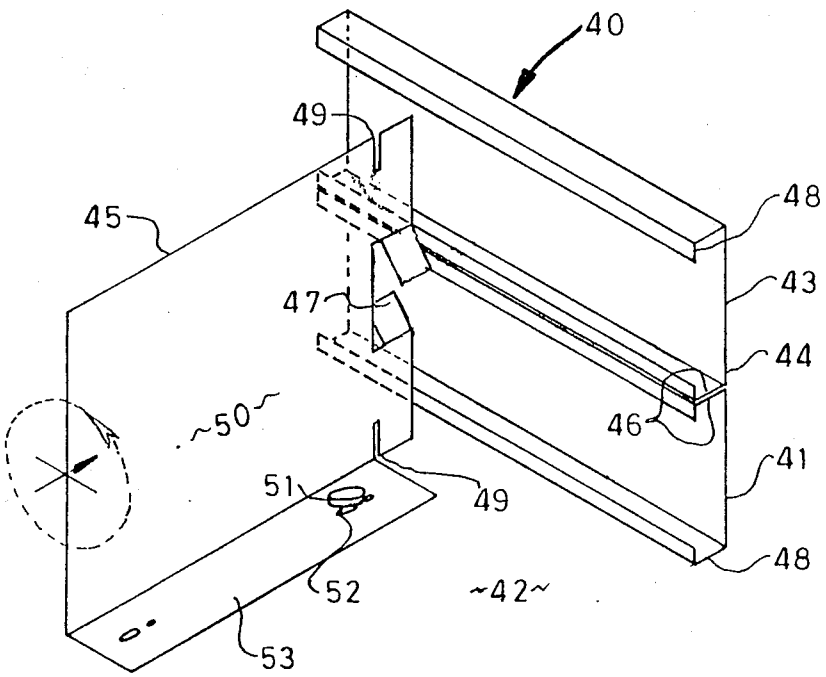
FIG. 4 is a pictorial view of a double-height mould formed from edge members and double-height brackets.
Figure 5:
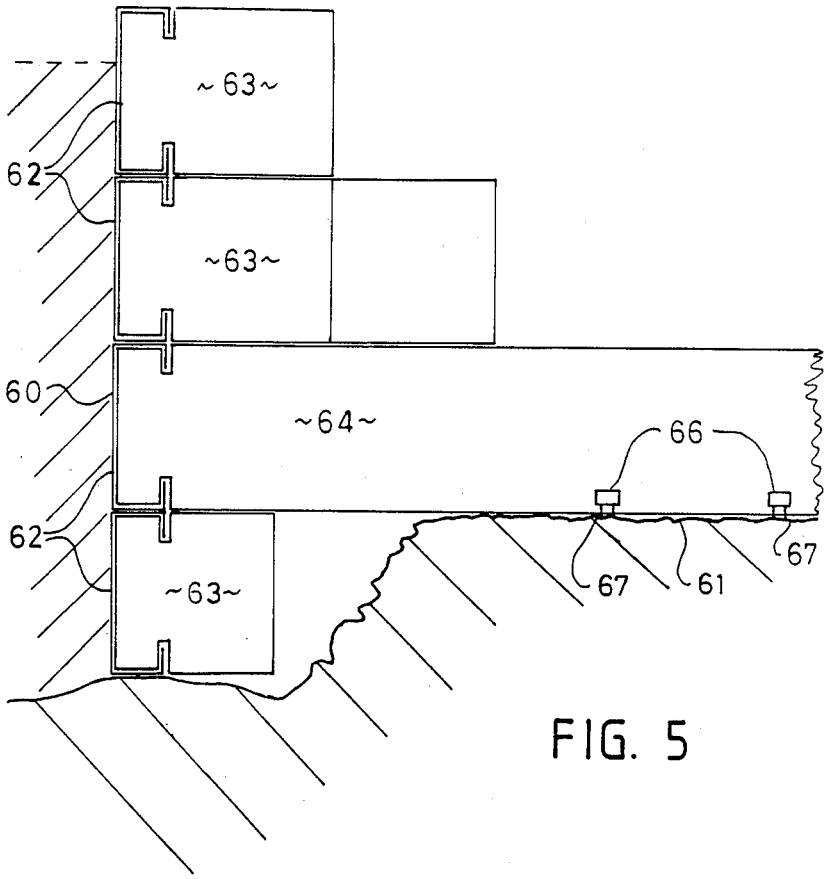
FIG. 5 is a cross-section of a multiple height mould formed from mould plates and extended-length brackets.

The double-height mould 40 shown in FIG. 4 is formed by placing a lower edge member 41 on a moulding surface 42 and placing an upper edge member 43 on top of the lower edge member 41 to form a vertical moulding surface 44. The upper and lower edge members 41 and 43 are then joined by engaging them with double-height bracket 45. The adjoining flanges 46 of the upper and lower edge members 41 and 43 are clamped together by the cutout 47, which is shaped such that it may be placed over the lips 48 of the adjoining flanges 46 when the double-height bracket 45 is inclined to the vertical, and that it engages with the adjoining flanges 46 when rotated. The extreme flanges 49 of the upper and lower edge members 41 and 43 are engaged with the notches 50 in the upper and lower edges of the web 51 of a double-height bracket 45 when it is rotated. The double-height bracket 45 is then secured to the moulding surface 42 by placing pegs 52 into holes 53 in the lower flange 54 of the double-height bracket 45.

Where a mould face 60 must be constructed remote from a surface 61 suitable for anchoring formwork, as shown in FIG. 5, a series of edge members 62 may be formed into the mould face 60 by engaging the edge members 62 with single-height brackets 63 which are then joined together and to an extended-length bracket 64 which extends rearwardly from the mould face 60 such that the lower flange 65 of the extended-length bracket 64 rests on a surface 61 to which it is clamped by pegs 66 driven through holes 67 in the lower flange 64.

Figure 6:
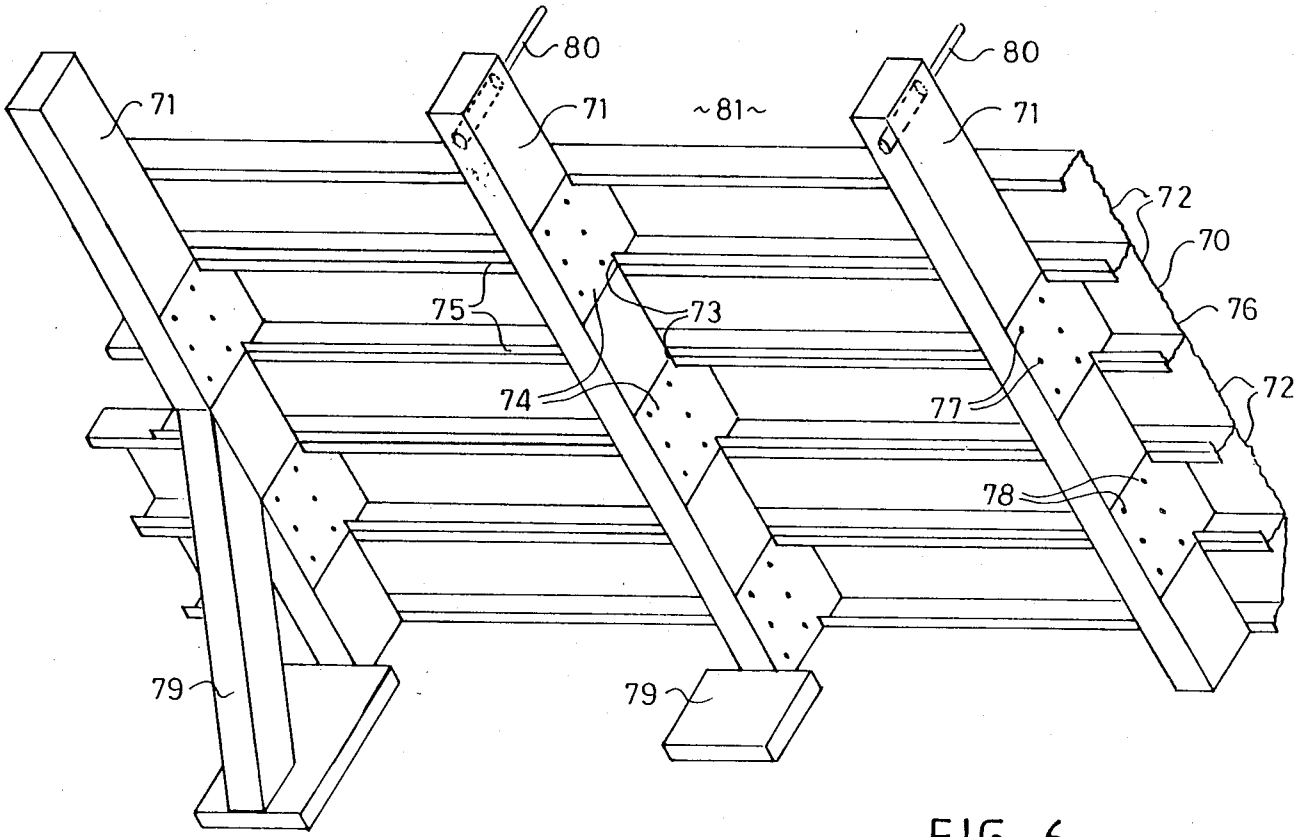
FIG. 6 is a pictorial view of a multiple height wall formed from edge members and timber, utilising nailing-type brackets.

The multiple-height mould face 70 shown in FIG. 6 is formed by placing a vertical row of timber studs 71 behind the line of the mould face 70 and building up the mould face 70 by stacking edge members 72 in front of the timber studs 71 and fastening the edge members 72 to the timber studs 71. The edge members 72 are fastened to the timber studs 71 by engaging the notches 73 formed in the nailing-type brackets 74 with the lipped flanges 75 extending rearward from the mould faces 76 of the edge members 72 and then clamping the nailing-type brackets 74 to the timber studs 71 by means of nails 77 driven through holes 78 in the nailing-type brackets. Braces 79 maintain the timber studs in an upright position, and tie-rods 80 pass across a moulding cavity 81 and engage with the timber studs of further mould formation apparatus.

Figure 7:
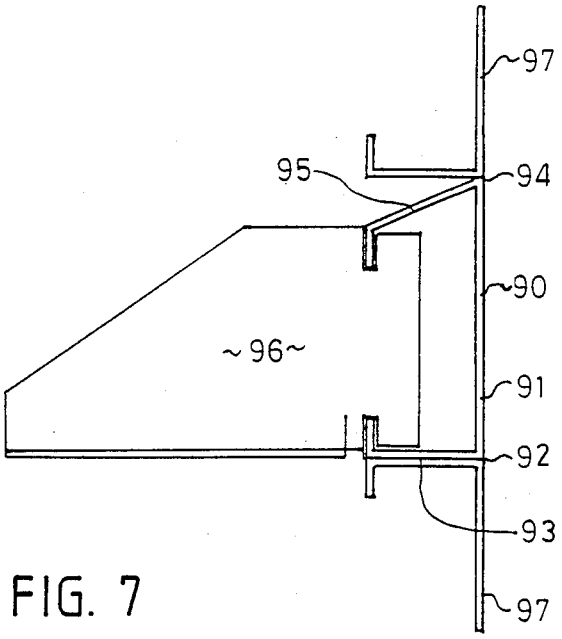
FIG. 7 is a cross-section of a free-stripping edge member adapted for removal from the mould by rotation about an edge.

The free-stripping edge member 90 shown in FIG. 7 has an elongate mould face 91, from one long edge 92 of which a perpendicular lipped flange 93 extends rearwardly and from the other long edge 94 of which an inclined lipped flange 95 extends at an acute angle to the mould face 91. A bracket 96 engages with the free-stripping edge member 90 and maintains it in alignment with other edge members 97.

When it is desired to remove edge members from the concrete mould face, the free-stripping edge member 90 may be removed by first removing the brackets 96 retaining the free-stripping edge member 90 and then pulling the perpendicular lipped flange 93 away from the concrete mould face, rotating the free-stripping edge member 90 about the other long edge 94. The angular disposition of the inclined lipped flange 95 permits this rotation to occur without the interference between the latter and the adjoining flange of the adjacent edge member. The other edge members 97 may then be removed utilising the clearance obtained by the removal of the free-stripping edge member 90.

Figure 8:
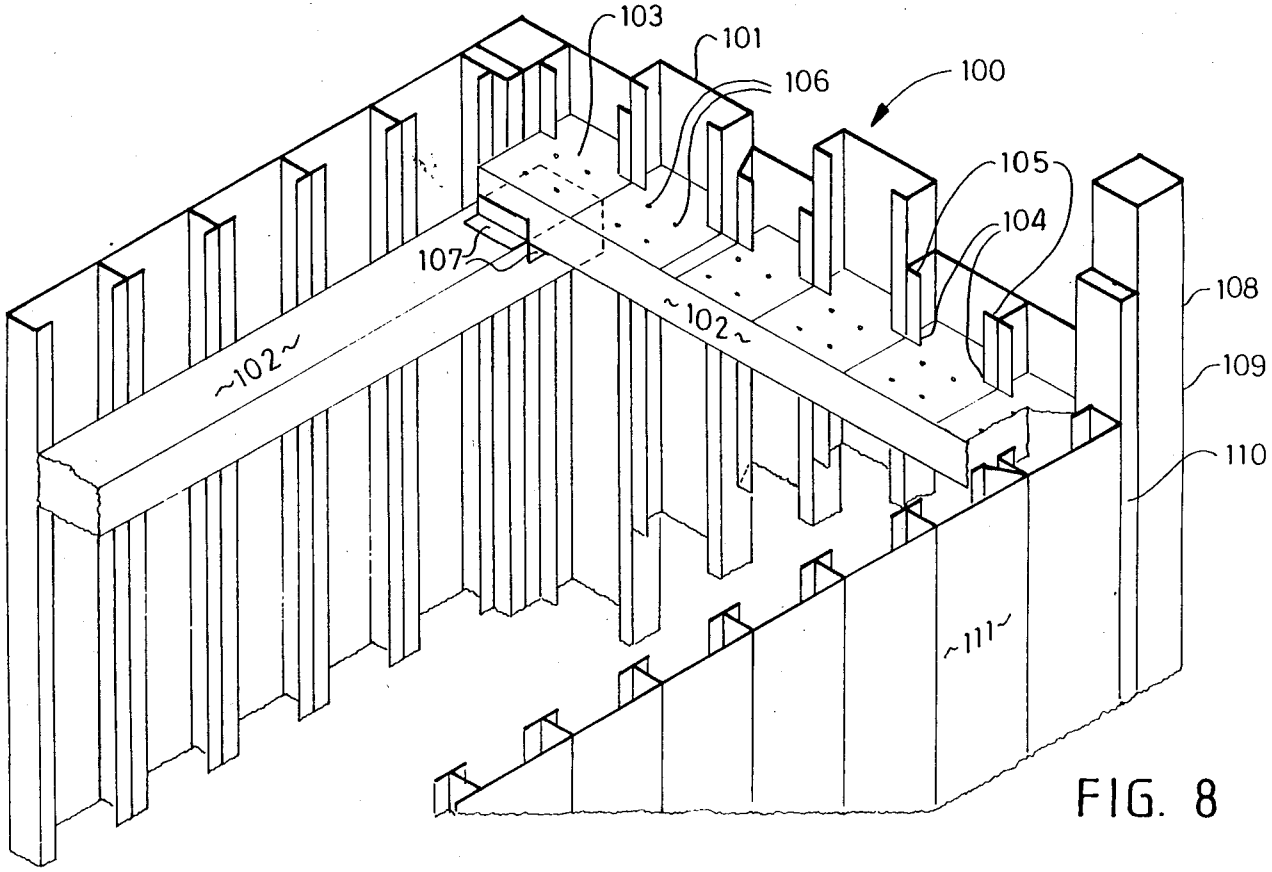
FIG. 8 is a pictorial view of a mould for forming an internal cavity in concrete using mould plates, timber, and nailing-type brackets.

The mould 100 for forming an internal cavity in concrete, as shown in FIG. 8, is constructed using vertical edge members 101 and horizontal timber wales 102. Nailing-type brackets 103 have notches 104 which engage with the lipped flanges 105 of the edge members 101 and are secured to the timber wales 102 by means of nails 106. Timber wales 102 are secured to one another at the corners of the mould 100 by nailing or by means of cleats 107. The edge members 101 do not extend into the corners 108 of the mould 100, allowing timber corner pieces 109 and timber packing pieces 110 to be inserted and attached to the timber wales 102 by nailing or bolting. Free-stripping edge members 111 are included in each face of the mould 100 to facilitate the removal of the edge members 101.

Figure 9:
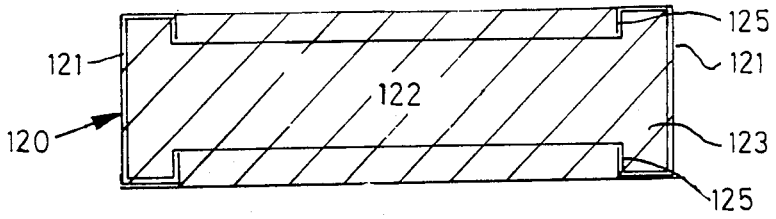
FIG. 9 is a cross-section of a concrete slab formed with edge members as side walls and with tie-plates as ligatures.

The concrete beam 120 shown in FIG. 9 is formed with edge members 121 as the side walls of the mould. Ligature brackets 122 which have connector blocks 123 in their opposed ends 124 engage with the lipped flanges 125 of the edge members 121 to hold the edge members in position while concrete is poured to form the beam 120. The ligature brackets 122 and the edge members 121 remain in place after the concrete has set to reinforce the beam 120.

Figure 10:
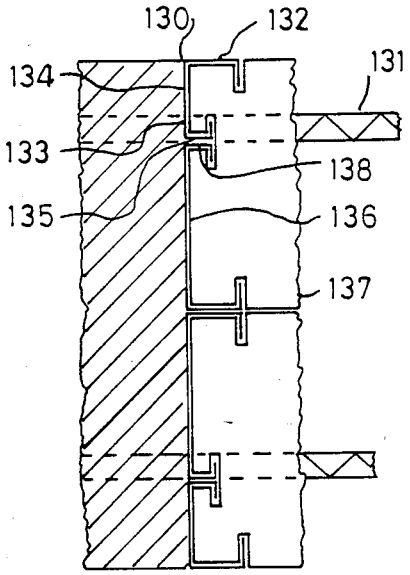
FIG. 10 is a cross-section of a set of edge members adapted for the location of projecting reinforcement rods.

The mould face 130 shown in FIG. 10 is adapted to allow reinforcing rods 131 to project through the mould face 130. A notched edge member 132 has notches 133 cut in the edge of its mould face 134 and in an adjoining flange 135. The notches 133 are shaped to conform as closely as possible to the cross-section of the reinforcing rods 131. A lower edge member 136 is placed in the mould face adjacent the adjoining flange 135 and a double-height bracket 137 joins edge members 132 and 136.

To form a concrete slab with reinforcing rods 131 projecting through the mould face 130, a lower edge member 136 is introduced into the mould face 130 with its upper edge 138 at the desired height for the reinforcing rods 131. The rods 131 are laid along the upper edge 138 at intervals equal to the notch spacing in the notched edge member 132. The notched edge member 136 is lowered over the rods 131, and clamped into engagement with the lower edge member 136 by the double-height bracket 137, forming a mould face 130 enclosing the rods 131. When it is desired to remove the mould face 130, the double-height bracket 137 is removed, and the notched edge member 136 is stripped from above the rods 131. The lower edge member 136 is then removed from below the rods 131.

Figure 11:
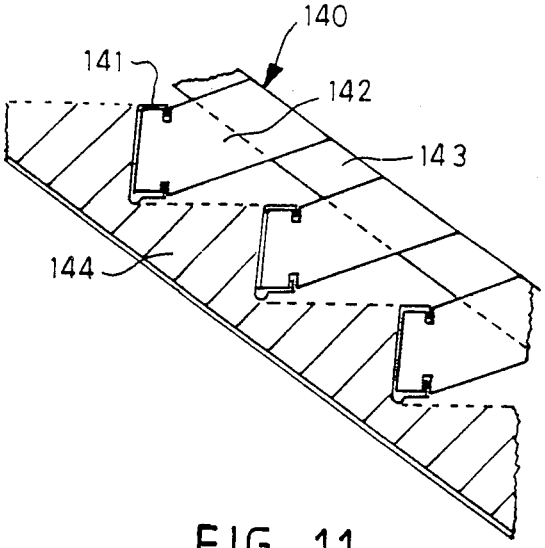
FIG. 11 is a cross-section of edge members and brackets adapted for the forming of concrete stairs.

As shown in FIG. 11, a formwork assembly 140 for concrete stairs may be formed by placing lipped channel members 141 across the riser sections of the steps, engaging supporting brackets 142 with the lipped channel members 141, and attaching the supporting brackets 142 to stringers 143 to form the formwork assembly 140. When it is desired to remove the formwork assembly 140, the supporting brackets 142 may be detached from the stringers 143, then twisted to disengage them from the lipped channel members 141. The lipped channel members 141 may then be stripped from the formed stairs 144.

Figure 12:
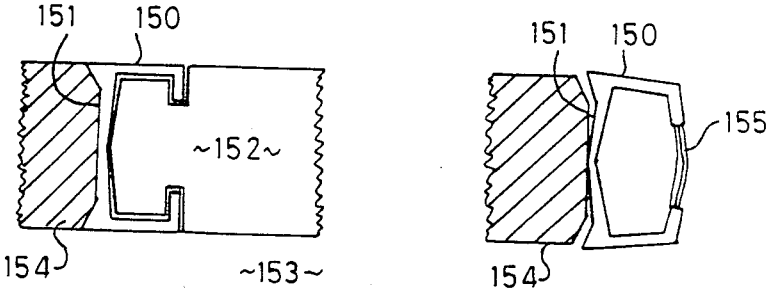
FIG. 12 is a cross-section of a flexible edge member and brackets.

The flexible edge member 150 shown in FIG. 12 may be used to form a mould face 151 for concrete when supported by brackets 152 which are attached to a surface 153. When it is desired to remove the flexible edge member 150 from the formed concrete 154, the brackets 152 are removed, and the handles 155 are pulled, bending the flexible edge member 150 and distorting the mould face 151 to facilitate separation of the mould face 151 from the formed concrete 154.

Figure 13:
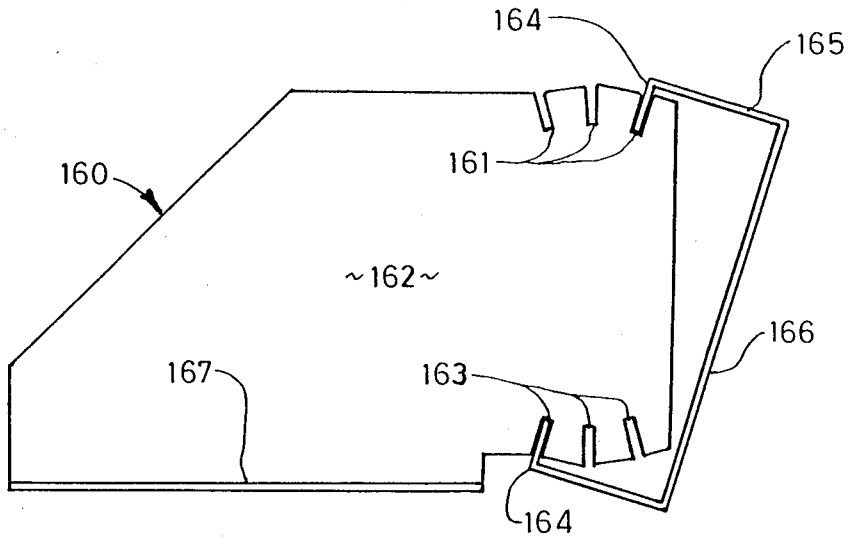
FIG. 13 is a side view of an adjustable bracket engaged with a lipped channel.

The adjustable bracket 160 shown in FIG. 13 has upper notches 161 formed in the upper end of the web 162 and lower notches 163 formed in the lower end of the web 162. Notch pairs, consisting of an upper notch 161 and a lower notch 163, are arranged in radial alignment, and the lips 164 of the lipped channel 165 may be engaged with any selected notch pair to produce a desired angle between the mould face 166 and the mounting flange 167 of the adjustable bracket 160.

The term concrete has been used in the specification for illustrative purposes. However, it is to be understood that the term concrete as used herein and in the claims is to be taken as a reference to any material which may be cast in liquid form to assume a shape defined by a mould cavity.

It will of course be realised that while the above has been given by way of illustrative example of this invention, all such and other modifications and variations thereto as would be apparent to persons skilled in the art are deemed to fall within the broad scope and ambit of this invention as is defined in the appended claims.

What is claimed is:

1. A mold supporting bracket for supporting concrete formwork upon a supporting surface, the concrete formwork being in the form of an elongate lipped-channel section of the type having a channel web, the front face of which forms a mold wall section, channel flanges extending rearwardly along opposite edges of the channel web and opposed channel lips extending inwardly along the free edges of the channel flanges, said mold supporting bracket including:

a rigid side wall having a front end portion which when pivoted about an axis normal to the channel web to incline said front end portion relative to the channel flanges is receivable between the channel flanges and the opposed channel lips;

an upper recess and a lower opposed recess extending inwardly from respective upper and lower edges of said front end portion and being engageable about the innermost edges of the opposed channel lips upon pivoting said front end portion about said axis so as to locate the lipped-channel section relative to said bracket, and a support mounting adjacent the rear end of said side wall and engageable with the supporting surface to hold said bracket and the located lipped-channel section in a selected orientation relative to said supporting surface, said support mounting being in the form of an apertured integral base wall extending substantially perpendicularly from and along the lower edge of said side wall rearwardly of said front end portion.

2. A mold supporting bracket according to Claim 1, wherein said support mounting is spaced rearwardly from said opposed slots by a distance equal to or greater than half the spacing between said upper and lower recesses.

3. A one-piece mold supporting bracket according to claim 1, wherein said side and base walls are formed whereby a further one of said mold supporting brackets is nestable within the region formed between said side wall and said base wall.

4. A mold supporting bracket according to claim 1, wherein said front end portion is provided with an intermediate slot for releasable engagement about adjoining lips of adjacent channel members stacked one upon the other to form a composite lipped channel section.

5. A mold supporting bracket according to claim 1, wherein there is provided a plurality of pairs of opposed slots in said front end portion of said side wall and wherein lines extending between respective pairs of said upper and lower recesses are inclined to said base wall at different selected angles.

6. A mold supporting bracket for supporting concrete formwork upon a supporting surface, the concrete formwork being in the form of a elongate lipped-channel section of the type having a channel web, the front face of which forms a mold wall section, channel flanges extending rearwardly along opposite edges of the channel web and opposed channel lips extending inwardly along the free edges of the channel flanges, said mold supporting bracket including:

a rigid side wall having a front end portion which when pivoted about an axis normal to the channel web to incline said front end portion relative to the channel flanges is receivable between the channel flanges and the opposed channel lips;

a plurality of pairs of upper and lower recesses extending inwardly toward each other from respective upper and lower edges of said front end portion , each pair defining a line extending therebetween, said lines being inclined at different selected angles relative to said lower edge wherein the opposed channel lips are engagable with one of said pairs to locate the lipped-channel section at a selected inclination relative to said bracket, and an integral base wall extending along said side wall rearwardly of said front end portion, said base wall being apertured to enable said bracket to be secured to a supporting surface to hold said bracket and the located lipped-channel section in a selected orientation relative to the supporting surface.

7. Concrete formwork including elongate lipped-channel section of the type having a channel web, the front face of which forms a mold wall section, channel flanges extending rearwardly along opposite edges of said channel web, opposed channel lips extending inwardly along the free edges of said channel flanges and a plurality of supporting brackets engageable with said lipped-channel section at selected positions along said lipped-channel section, each of said brackets including:

a rigid side wall having a front end portion which when pivoted about an axis normal to said channel web to incline said front end portion relative to said channel flanges is receivable between said channel flanges and said opposed channel lips;

upper and lower opposed recesses extending inwardly from respective upper and lower edges of said front end portion wherein said opposed channel lips are engagable with said opposed recesses to locate said lipped-channel section at a selected inclination relative to said bracket, and an integral base wall extending substantially perpendicularly from and along the lower edge of said side wall rearwardly of said front end portion, said base wall being apertured to enable said bracket to be secured to a supporting surface to hold said bracket and said located lipped-channel section in a selected orientation relative to the supporting surface.

* * * * *